US006260803B1

(12) United States Patent
Hunts

(10) Patent No.: US 6,260,803 B1
(45) Date of Patent: Jul. 17, 2001

(54) KITE TETHER CONTROL WITH ATTACHMENT TO THE BODY

(76) Inventor: Rick E. Hunts, 9389 Dowdy Dr., Suite D, Charmasson & Buchaca Law Offices, San Diego, CA (US) 92108-3412

( * ) Notice: Subject to any disclaimer, the term of this patent is extended or adjusted under 35 U.S.C. 154(b) by 0 days.

(21) Appl. No.: 09/525,959

(22) Filed: Mar. 15, 2000

(51) Int. Cl.[7] ..... B64C 31/06

(52) U.S. Cl. ..... 244/155 R; 244/155 A; 242/389; 242/405

(58) Field of Search ..... 244/155 A, 153 R, 244/155 R; 242/389, 405; 114/102

(56) References Cited

U.S. PATENT DOCUMENTS

| | | | | |
|---|---|---|---|---|
| 3,355,129 | | 11/1967 | Kinsey | 244/155 |
| 3,421,722 | | 1/1969 | May et al. | 244/155 |
| 3,630,464 | | 12/1971 | Fagan | 242/96 |
| 3,807,672 | * | 4/1974 | Williams | 244/155 A |
| 4,129,273 | | 12/1978 | Hill | 244/155 |
| 4,172,567 | | 10/1979 | Post | 242/96 |
| 4,452,161 | | 6/1984 | McCoy | 114/39 |
| 4,821,976 | | 4/1989 | Nakashima | 242/96 |
| 5,190,237 | | 3/1993 | Fagan | 242/96 |
| 5,277,350 | | 1/1994 | Thornbury, Jr. | 244/155 |
| 5,366,182 | | 11/1994 | Kiteski | 244/155 |
| 5,417,390 | * | 5/1995 | Southwick | 244/155 A |
| 6,145,789 | * | 11/2000 | Matlin et al. | 244/155 A |

* cited by examiner

*Primary Examiner*—J. Woodrow Eldred
(74) *Attorney, Agent, or Firm*—John D. Buchaca; Henri J. A. Charmasson

(57) ABSTRACT

A multi-tether kite control device uses a racheting mechanism to rewind the tether reels. The mechanism is activated by a pull-string attached to the belt or torso of the operator. By repetitively moving the device away from and toward his body, the operator can rewind one or both tethers without releasing his grasp upon the device handles. Separate reels are used to coil the tethers attached to the leading edges of the kite to provide a controlled braking action.

17 Claims, 3 Drawing Sheets

KITE TETHER CONTROL WITH ATTACHMENT TO THE BODY

FIELD OF THE INVENTION

This invention relates to reel, spool and wench-winding mechanisms, and more particularly to tether winding mechanisms used in connection with kites.

BACKGROUND OF THE INVENTION

Hand-held control assemblies associated with lightweight airborne devices such as kites, model airplanes and similar airfoils usually comprise one or more reels upon which tethers are wound or unwound as part of various control maneuvers. These devices necessarily include a handle for support as well as additional hand cranks or other graspable implements for activating one or more reels. Specimens of the prior art devices are disclosed in U.S. Pat. No. 3,355,129 Kinsey, and U.S. Pat. No. 4,172,567 Post. The rewinding of one or more tethers requires considerable effort, yet this rewinding must be done with a single hand since the other hand is necessarily supporting the device. Moreover, when the two reels are independently mounted as in Post above, the tethers cannot be rewound simultaneously as is often required during the control of a mulit-tether kite.

The braking of certain kites requires a differential recoiling of the tethers controlling the leading and trailing edges of the kite upon synchronized pairs of reels in which the reel trailing edges of tether must lag the recoil of the leading edge tether reel. Thus, compounding the aforesaid rewinding difficulties.

Kites and other free-flying airfoils are also used to provide a towing force to water skiers, surfers, as well as riders of some wheeled land vehicles. As disclosed in U.S. Pat. No. 5,366,182 Roeseler et al., the kite control apparatus, in such case, can be complex, and particularly awkward, if not impossible, to support with a single hand when the other hand is busy activating the tether rewinding mechanism.

The instant invention results from an attempt in improving the controllability of single as well as multi-tethered kites, and other such free-flying airfoils.

SUMMARY OF THE INVENTION

The principal and secondary objects of this invention are to provide a multi-reel tether winding device suitable for controlling the flight of a kite or similar free-flying airfoil by providing a versatile and accurate winding and unwinding of each tether while keeping a stable supporting control of the entire mechanism.

These and other valuable objects are achieved by the coupling two pairs of tether winding reels to a spool-and-rachet winding mechanism which is driven by the unwinding of a pull-strap or string attached to the belt or torso of the operator whereby the winding mechanism is activated by repetitively moving the kite control mechanism away from and toward the body. In each pair, one of the reels carries the tether attached to the leading edge of the kite, and the other tether is attached to the trailing edge. A controlled slippage between the leading edge and trailing edge spool-and-rachet assembly and edge reels allow for a controlled retrieve and braking of the kite.

DESCRIPTION OF THE PREFERRED EMBODIMENT OF THE INVENTION

Figure 1:
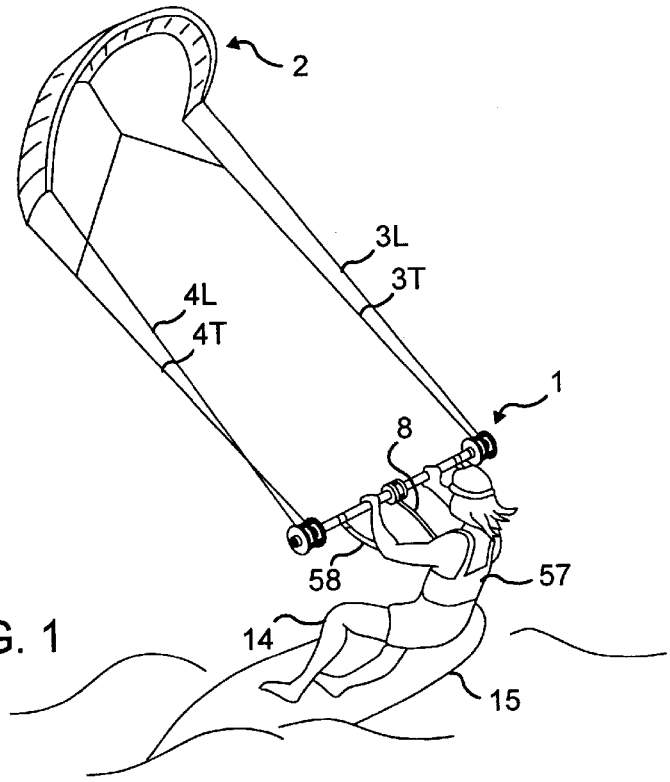
FIG. 1 illustrates the use of a kite control device according to the invention.
Figure 2:
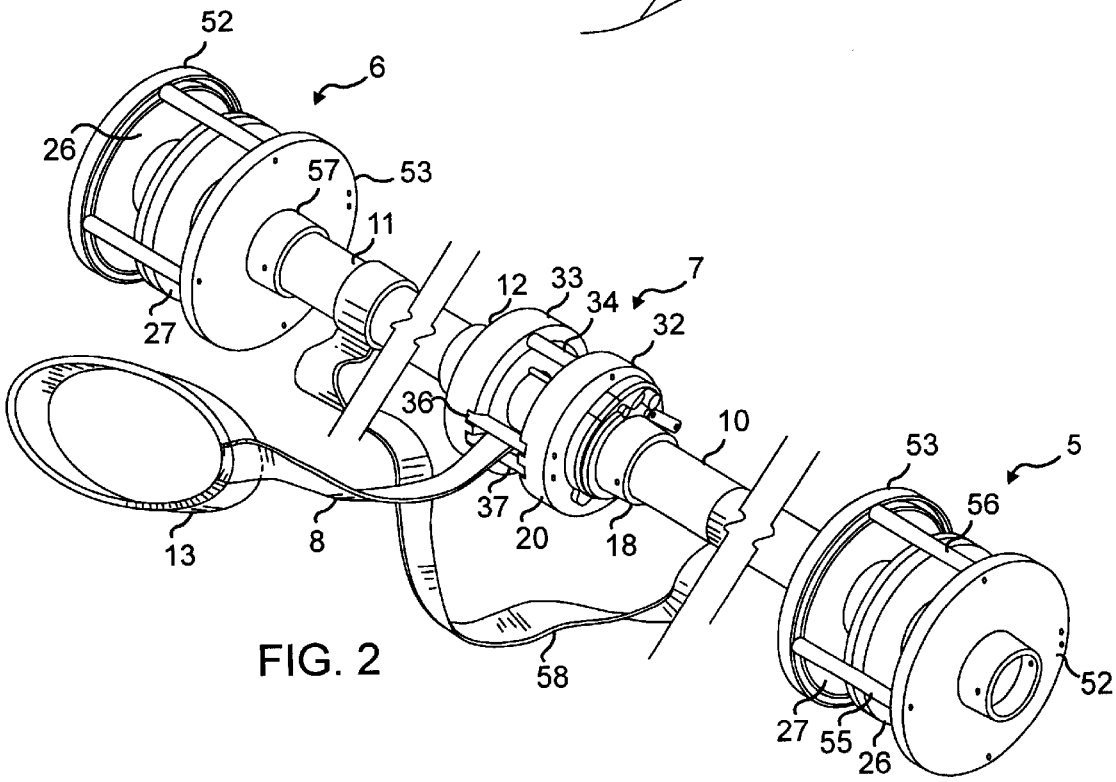
FIG. 2 is a perspective view of the device.
Figure 3:
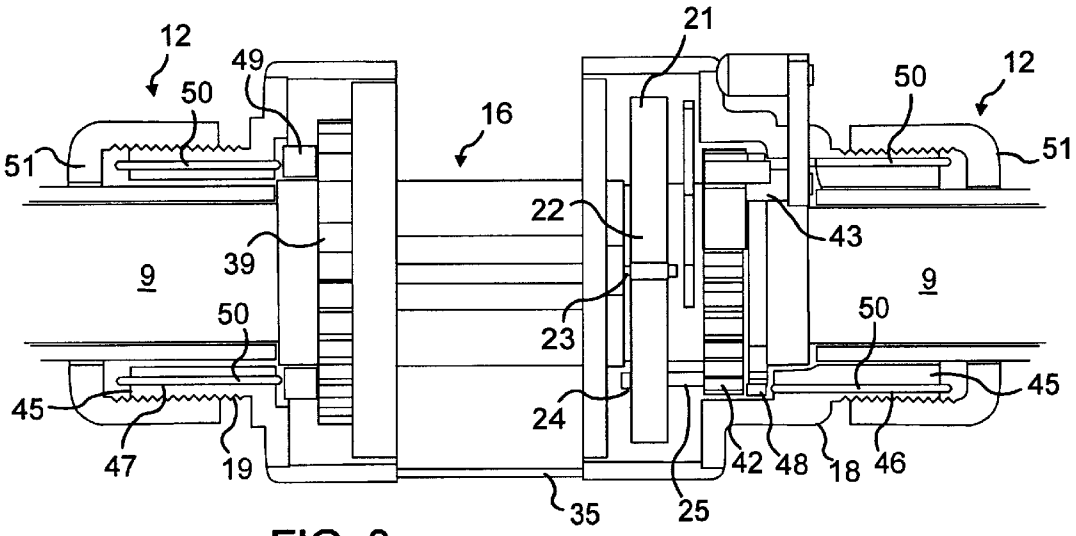
FIG. 3 is a cross-sectional view of the winding mechanism.
Figure 4:
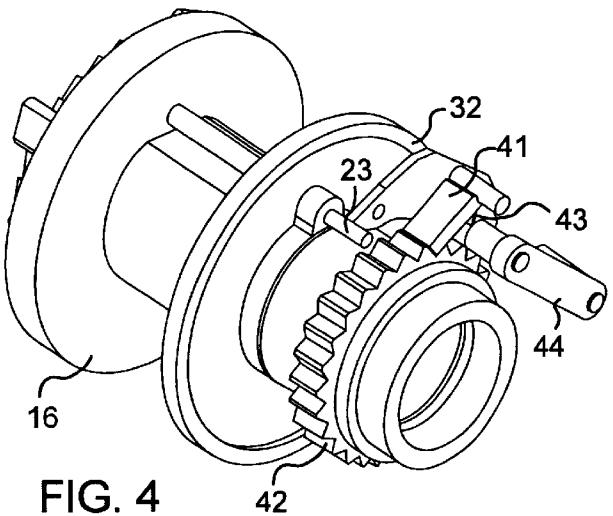
FIG. 4 is a perspective view of the inside portion of the winding mechanism.
Figure 5:
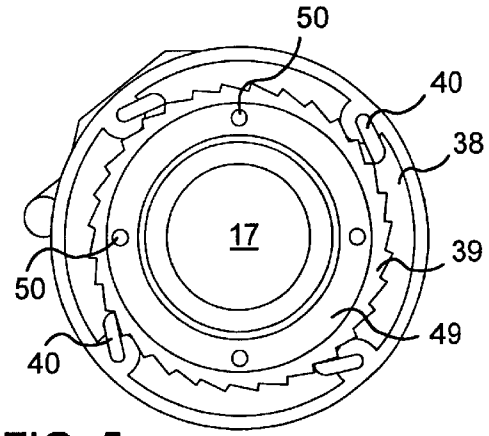
FIG. 5 is a left view of the spool-winding rachet mechanism.

Referring now to the drawing, there is shown a kite control device 1 specifically adapted for controlling a kite 2 having two pairs of separate and independent tethers 3L, 3T, and 4L, 4T. The device provides for simultaneous winding and release of the tethers by means of two dual reel assemblies 5, 6. Between the two reel assemblies, a winding mechanism 7 is activated by the pulling of a strap 8 or other equivalent component. The entire device is mounted upon a shaft 9 sheathed by coaxial, tubular handlebars 10, 11. The uncoiling rotation of the shaft is controlled by a finger-operable brake 12 associated with the winding mechanism. At the free end of the pull-strap 8 a loop member 13 is preferably attached to a body part of the operator 14 of the device. The pulling of the strap is accomplished by that operator moving the kite control device away from that body part. A spring-loaded racheting mechanism is used to recoil the pull-strap into the winding mechanism when the operator pulls the kite control device toward the body part to which the end of the pull-strap is attached. The device is particularly useful in situations where accurate control of the kite tethers is critical. Such a situation exists in the case of a kite being used to propel an operator riding a surfboard 15, water skis or even a wheeled land vehicle.

The pull-strap is wound upon a spool 16 rotatively mounted upon a median section 17 of the shaft and held by a pair of collars or flanges 18, 19 mounted astride the housing 20 of the winding mechanism 7 and secured to the handlebars 10, 11. A return coil-spring 21 within said housing has a first end 22 attached to a pin 23 projecting from a side wall of the spool. The opposite end of the spring 24 is attached to a pin 25 mounted on the periphery of the housing 20. Accordingly, as the strap 8 is pulled off the spool, causing the spool to rotate, the coil-spring 21 is progressively wound tightly upon itself. When the pulling force upon the strap ceases, the return force accumulated by the spring rewinds the strap 8 upon the spool 16.

Figure 6:
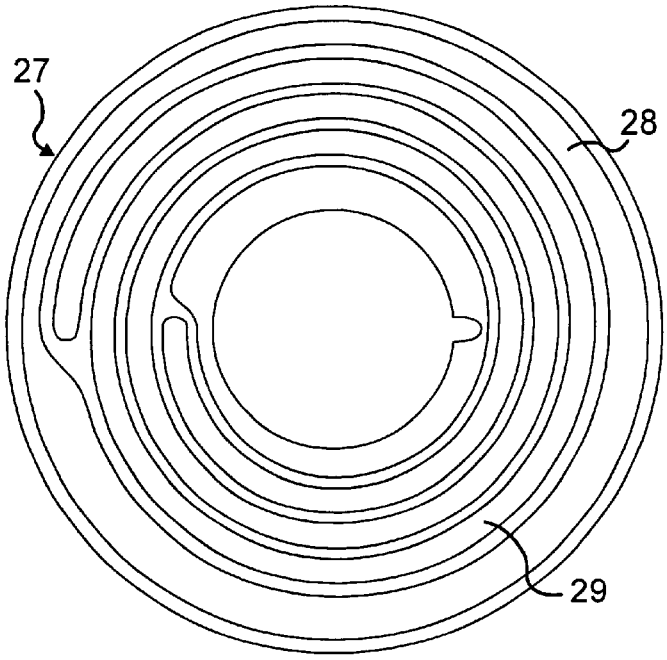
FIG. 6 is a right side view of auxiliary reel.
Figure 7:
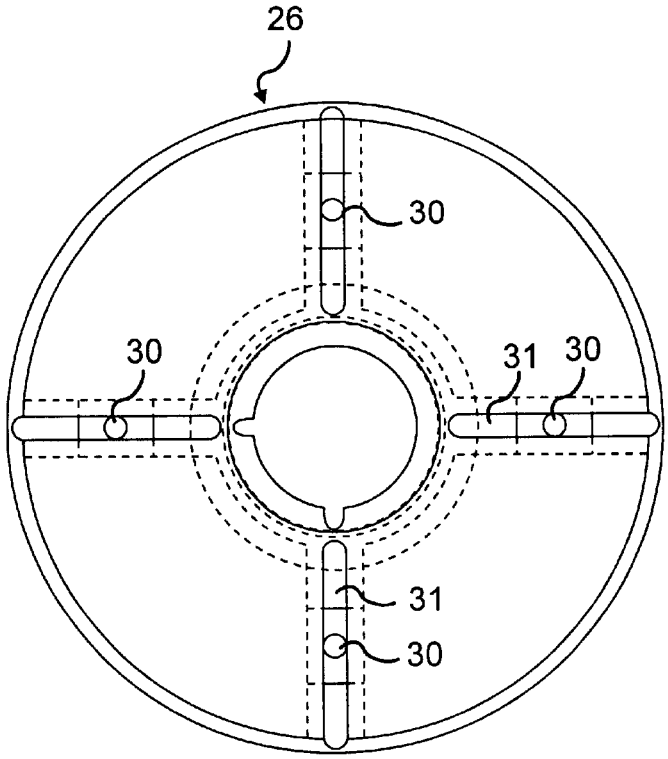
FIG. 7 is a left side view of the main reel.

Each of the two reel assemblies 5, 6 mounted on the shaft 9 on either side of the pull-strap spool 16 comprises a main reel 26 fixedly mounted upon an end section of the shaft. That reel is shaped and dimensioned to accept the full length of one of said tethers 3L attached to the leading edge of the kite. An auxiliary reel 27 is rotatively engaged upon the shaft proximate the mail reel; that is, not directly coupled to the shaft. This auxiliary reel is shaped and dimensioned to accept the full length of a second tether 3T secured to the trailing edge of the kite. As illustrated in FIGS. 6 and 7, the outer wall surface 28 of the auxiliary reel facing the main reel defines a spiral groove 29 having a circular length of approximately three turns. Pins 30 projecting from the outer wall surface of the main reel facing the auxiliary reel engages the spiral groove 29. Each pin is slidingly mounted into a radial channel 31, and can thus, follow the groove when the auxiliary reel rotates independently from the mail reel. This slippage between the main and auxiliary reels is particularly useful a kite braking maneuver wherein the leading edge of the kite is pulled and the trailing edge is let go in order to reduce towing power of the kite.

The housing 20 of the winding mechanism 7 comprises two half-shells 32, 33 bridged by spacers 34, 35 and a pair of closely spaced-apart guiding baffles 36, 37 between passes the pull-strap 8. The collars or flanges 18, 19 of the half-shells are secured to the handlebars. Mounted on the shaft 9 against the left wall 38 of the spool 16 is a rachet gear 39 which is engaged by a set of flying pawls 40. Each pawl is rotatively secured to the periphery of that wall. The teeth of the gear and cooperating pawls are oriented to cause the spool to drive the shaft into a winding movement of the main reels when the strap 8 is pulled and unwound from the spool. The pawls 40 are flipped into engagement with the gear 39 by a toggling bar (not shown) associated with the left half 33 of the housing and positioned to be contacted by any un-engaged pawls as the spool rotates under the pull of the strap.

A similar flying pawl 41 rotatively mounted at one end against the right half 32 of the housing is shaped and dimensioned to come into engagement with a toothed gear 42 fixedly mounted on the shaft 9. An eccentric cam 43 controlled by a flip-handle 44 is shaped and dimensioned to seletively lift the pawl 41 away from the gear 42, or bring it into engagement with the gear teeth depending upon the position of the flip-handle 44.

Wall portion 45 of the winding mechanism's right and left half-shells 32, 33 have a series of horizontal bores 46, 47 across from the face of the rachet gears 42, 39. A bronze ring 48, 49, is mounted against the face of each rachet get. The ring is contacted by sets of push rods 50 engaged into the bores 46,47. On each side of the winding mechanism's housing, a capping member 51 is coaxially threaded over one of the half-shell's flange or collar 18, 19. Each capping member has an internal surface that bears against the back of the set of push rods. Turning the capping member clockwise moves the push rods inwardly against the bronze ring 48, 49. The ring comes into frictional contact with the adjacent gear 42, 39; thus acting as a finger-operable brake during the tether unwinding movement of the shaft and reels. Accordingly, the operator of the device can, without losing grasp of the handles, operate either the flip-handle 44 with his or her right thumb or rotate the capping member with the right or left thumb. The former maneuver frees or immobilizes the shaft by locking it to the right handle. The latter provides a braking control of the unwinding of the tethers from the reels. Each of the reel assemblies 5, 6 is also sandwiched between two halves 52, 53 of a shell that are bridged by a set of spacer bars 55, 56 which help in controlling the tethers and prevent snagging during their unwinding. Each reel assembly is secured to the outer end of one of the handles by the flange or collar 57 of the left half-shell 53. The coaxial arrangement of the spool, gears, handles, reels, and housing around a single shaft, yields a very compact and efficient kite control apparatus. The spool and reel assembly housings combined with the handles, form a rigid, elongated armature which allows for convenient separation of the tethers and for efficient control of the kite. The ring or loop member 13 at the end of the pull-strap 8, or any other fastener, is designed to attached to the torso of the operator by means of a harness 57 provided with a quick release mechanism such as the one disclosed in U.S. Pat. No. 4,452,161 McCoy, which patent is incorporated by reference in this specification.

A bridle 58 attached at each end to one of the handles, can also be secured to the harness 57. Such a bridle is particularly useful in relieving the stress applied to the operator's arms by the pull of the kite under a strong wind.

It should be noted that the reel assemblies 5, 6 could be set further apart on a longer shaft by lengthening the handles. The spreading apart of the reel mechanisms may improve the kite control. Additional reel assemblies can be mounted on the shaft for use in the handling of more complex kite structures.

While the preferred embodiments of the invention have been described, modifications can be made and other embodiments may be devised without departing from the spirit of the invention and the scope of the appended claims.

What is claimed is:

1. A kite control device which comprises:

a shaft;

first and second tubular handles coaxially engaged upon said shaft, said handles being shaped, spaced-apart and dimensioned to be hand-grasped by an operator;

a first reel mounted on a first end section of said shaft;

a first kite tether wound upon the said first reel;

a spool coaxially engaged over a median secton of said shaft between said first and second handles;

a pull-strap having a proximal end, and a distal end section wound upon said spool;

a fastener at said proximal end of the pull-strap for attachment to a body part of said operator;

a first rachet mechanism between said spool and said shaft;

a first spring resiliently biasing said spool against unwinding movement of said pull-strap;

said rachet mechanism being oriented to cause the spool to drive said shaft when said pull-strap is unwound from the spool; and a first hand-operable locking mechanism between said shaft and said first handle.

2. The device of claim 1, wherein said locking mechanism comprises a toothed disk mounted on said shaft proximate said rachet mechanism;

a pawl having a first end portion rotatively linked to said first handle and a second opposite end portion shaped and dimensioned to engage with said toothed disk;

an eccentric cam rotatively mounted proximate said pawl and being shaped and dimensioned to contact and move said cam away from said toothed disk when in a release orientation; and a control lever linked to said cam.

3. The device of claim 1, which further comprises:

a second reel coaxially mounted on said shaft on an opposite side of said first reel; and a second kite tether wound upon said second reel.

4. The device of claim 1 which further comprises:

a first auxiliary reel coaxially and rotatively mounted on said shaft proximate said first reel;

said auxiliary reel having a side surface facing said first reel;

said side surface defining a groove, and a pin projecting laterally from said first reel into said groove; and whereby the auxiliary reel is led through said pin by the rotation of said first reel.

5. The device of claim 4, wherein said pin is slidingly secured to said first reel along a radial line; and said groove has a spiral shape;

whereby said auxiliary reel can freely rotate in relation to said first reel to the extent of the least of said grooves.

6. In a kite control device including at least one reel for winding at least one tether of said kite, and at least one handle shaped and positioned to be grasped by an operator, an improvement which comprises:

a winding mechanism coupled to said reel, said winding mechanism including:

a spool;

a strap having a distal end section wound upon said spool and an opposite proximal end;

a spring resiliently biasing said spool against the unwinding of said string; and a racheting coupler between said spool and said reel;

whereby said operator can, by repetitively pulling and releasing said string, cause unwinding and rewinding of said end section of the string and drive said reel into a rewinding movement of said tether.

7. The improvement of claim 6 which further comprises a fastener attached to the proximal end of said string and being shaped and dimensioned to be secured to a body part of said operator;

whereby said operator can rewind said tether by repetitively moving said device away from said part.

8. The improvement of claim 7, which further comprises a hand-operable locking mechanism for releasably locking said reel to said handle.

9. The improvement of claim 7, which further comprises an hand-actuated brake operating upon said reel.

10. A kite control device which comprises:

at least one reel for winding at least one tether;

an armature rotatively mounting said reel, said armature having at least one end-graspable location for support of said device by an operator;

a reel-winding mechanism mounted on said armature;

a pullable component mounted on, and driving said winding mechanism; and means for attaching said component to a body part of said operator;

whereby said winding mechanism can be activated by repetitively moving said armature away from and toward said body part.

11. The device of claim 10, wherein said armature comprises a tubular sheath defining first and second handles astride said reel-winding mechanism.

12. The device of claim 11, wherein said reel-winding mechanism comprises:

a spool;

a pull-strap wound over said spool; and a rachet mechanism between said reel, said rachet mechanism being mounted and oriented to drive said reel by the unwinding of said string and resulting rotative movement of said spool.

13. The device of claim 12, which further comprises:

a shaft engaged through said handles and reel-winding mechanism;

first and second reels secured at opposite ends of said shaft; and a releasable coupling mechanism between said reel-winding mechanism and said shaft.

14. The device of claim 13 which further comprises:

a first auxiliary reel coaxially and rotatively mounted on said shaft proximate said first reel;

said auxiliary reel having a side surface facing said first reel;

said side surface defining a groove, and a pin projecting laterally from said first reel into said groove; and whereby the auxiliary reel is led through said pin by the rotation of said first reel.

15. The device of claim 14, wherein pin is slidingly secured to said first reel along a radial line; and said groove has a spiral shape;

whereby said auxiliary reel can freely rotate in relation to said first reel to the extent of the least of said grooves.

16. The device of claim 15 which further comprises:

a second auxiliary reel coaxially and rotatively mounted on said shaft proximate said first reel;

said auxiliary reel having a side surface facing said first reel;

said side surface defining a groove, and a pin projecting laterally from said first reel into said groove; and whereby the auxiliary reel is led through said pin by the rotation of said first reel.

17. The device of claim 16, wherein pin is slidingly secured to said first reel along a radial line; and said groove has a spiral shape;

whereby said auxiliary reel can freely rotate in relation to said first reel to the extent of the length of said groove.

* * * * *